US008814419B1

(12) United States Patent
Chester

(10) Patent No.: US 8,814,419 B1
(45) Date of Patent: Aug. 26, 2014

(54) CHESTA VORTEX ORGANIZER

(71) Applicant: Frank Chester, San Francisco, CA (US)

(72) Inventor: Frank Chester, San Francisco, CA (US)

( * ) Notice: Subject to any disclaimer, the term of this patent is extended or adjusted under 35 U.S.C. 154(b) by 0 days.

(21) Appl. No.: 14/297,392

(22) Filed: Jun. 5, 2014

(51) Int. Cl.
*B01F 7/16* (2006.01)
*B01F 7/00* (2006.01)

(52) U.S. Cl.
CPC ..... *B01F 7/0025* (2013.01)
USPC ..... 366/129; 366/343

(58) Field of Classification Search
CPC ... A47J 43/1043; A47J 43/07; A47J 43/0705; A47J 2043/04409; A47J 43/10
USPC ..... 366/129, 343, 342
See application file for complete search history.

(56) References Cited

U.S. PATENT DOCUMENTS

| | | | | | |
|---|---|---|---|---|---|
| 167,493 | A * | 9/1875 | Bright et al. | 366/343 |
| 188,383 | A * | 3/1877 | Leslie | 241/169.2 |
| 208,533 | A * | 10/1878 | Mitchel | 416/76 |
| 579,668 | A * | 3/1897 | Wilson | 416/65 |
| 719,467 | A * | 2/1903 | Holder | 241/169.2 |
| 1,241,307 | A * | 9/1917 | Tompkins | 366/129 |
| 1,766,171 | A * | 6/1930 | Hetherington | 241/301 |
| 2,167,218 | A * | 7/1939 | Nelson | 68/134 |
| 2,659,581 | A * | 11/1953 | Gray | 416/175 |
| 2,673,077 | A * | 3/1954 | Messbauer | 416/185 |
| 3,319,940 | A * | 5/1967 | Mentnech | 416/131 |
| 3,333,831 | A * | 8/1967 | Chapman | 366/129 |
| 3,630,636 | A * | 12/1971 | Hill | 416/199 |
| 4,260,267 | A * | 4/1981 | Walton | 366/343 |
| 5,073,033 | A * | 12/1991 | Klepeis | 366/343 |
| 5,470,148 | A * | 11/1995 | Gorr et al. | 366/64 |
| 5,599,103 | A * | 2/1997 | Linscott | 366/343 |
| 5,938,332 | A * | 8/1999 | Bachellier | 366/330.1 |
| 6,736,538 | B2 * | 5/2004 | Bittner | 366/199 |

* cited by examiner

*Primary Examiner* — Tony G Soohoo
(74) *Attorney, Agent, or Firm* — Steven A. Nielsen; Allman & Nielsen, P.C.

(57) ABSTRACT

Blade systems mix fluids and/or air to create and organize unique vortexes. The vortexes periodically implode to provide superior mixing. The blade structures may comprise four fold lines upon a circular planar surface. The planar surface may be prepared by removal of just one small portion of material, the removed portion spanning approximately one radian of the perimeter.

5 Claims, 9 Drawing Sheets

CHESTA VORTEX ORGANIZER

CROSS-REFERENCE TO RELATED APPLICATIONS

Not Applicable

BACKGROUND OF THE INVENTION

Field of the Invention

The invention generally relates to mixer systems. More particularly, the invention relates to means and methods of mixing material and/or organizing vortexes within fluids in motion.

BRIEF SUMMARY OF THE INVENTION

The present invention overcomes shortfalls in the related art by presenting an unobvious and unique combination and configuration of mixing blade geometry resulting in superior fluid dynamics. Disclosed embodiments of the invention include efficient patterns placed upon flat sheets of material whereby little material is wasted and few folds are made in the construction of mixing blades. In one embodiment, three symmetrical blades are attached together to form a mixing blade system. The disclosed geometry allows for secure attachment of mixing blades by joining select surfaces of identical angles and surface areas that also form surfaces useful for mixing, vortex organization and vortex implosions.

In one embodiment, three of the disclosed blades are identical and are attached in an equilateral triangle formation at an approximate angle of 26 degrees from a vertical reference center line projection. A disclosed blade efficiently comprises four fold lines upon a circular planar surface and the removal is just one a small portion of material, the removed portion spanning approximately one radian of the perimeter.

These and other objects and advantages will be made apparent when considering the following detailed specification when taken in conjunction with the drawings.

REFERENCE NUMERALS AND LETTERS IN THE DRAWINGS

Figure 1:
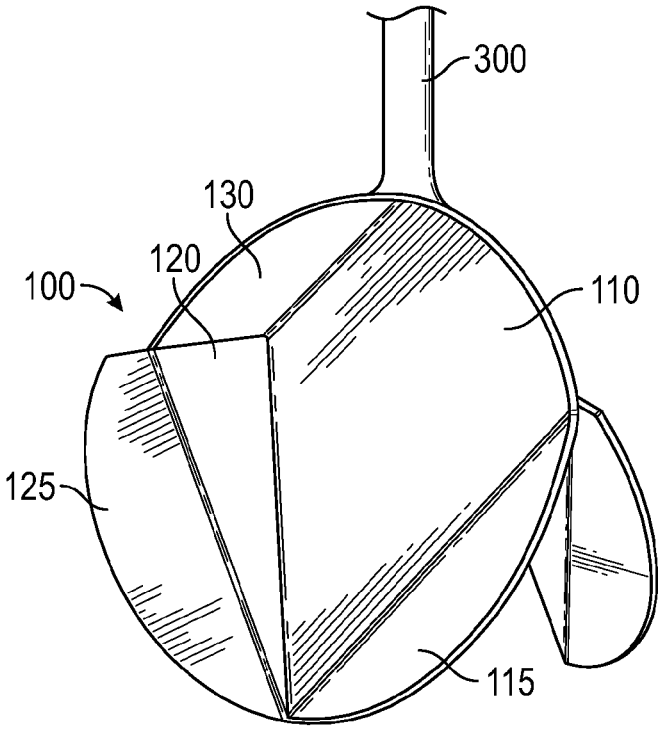
FIG. 1 is a perspective view of a disclosed embodiment

100 is a mixing blade in general
110 is a main flat base section
115 is an outer flap section
120 is a middle flap section
125 is an inner flap section
130 connection flap
300 is a mixing shaft, connected to three connected mixing blades
301 center system line, may be aligned with a mixing shaft
400 a mixing system
500 a first fold line
501 a second fold line
503 a third fold line
510 a base circle
520 portion of base circle sometime removed
525 a first linear boundary of the removed base circle portion 520
530 a second linear boundary of the removed base circle portion 520
A' is A prime and is a bottom center point within the base circle
A is opposite of A' and is on the top of the base circle
B is a point to the left of A' and point B is adjacent to arc 1
C is a point between points B and A, point C is the only point not found upon the perimeter of the base circle
D is a point found to the right of A', the perimeter of the base circle between points A' and D define arc 2
arc 1 is found between points A' and B
arc 2 is found between points A' and D
arc 3 is found between points D and A
line A'-B is sometimes a fold line that is bent 12 degrees backwards
line A'-C is sometimes a fold line that is bent 42 degrees forward
line A'-D is sometimes a fold line that is bent 50 degrees forward
CL means center line
base circle means a circle drawn as points of reference for construction of embodiments of the disclosed invention

DETAILED DESCRIPTION OF EMBODIMENTS OF THE INVENTION

The following detailed description is directed to certain specific embodiments of the invention. However, the invention can be embodied in a multitude of different ways as defined and covered by the claims and their equivalents. In this description, reference is made to the drawings wherein like parts are designated with like numerals throughout.

Unless otherwise noted in this specification or in the claims, all of the terms used in the specification and the claims will have the meanings normally ascribed to these terms by workers in the art.

Unless the context clearly requires otherwise, throughout the description and the claims, the words "comprise," "comprising" and the like are to be construed in an inclusive sense as opposed to an exclusive or exhaustive sense; that is to say, in a sense of "including, but not limited to." Words using the singular or plural number also include the plural or singular number, respectively. Additionally, the words "herein," "above," "below," and words of similar import, when used in this application, shall refer to this application as a whole and not to any particular portions of this application.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while steps are presented in a given order, alternative embodiments may perform routines having steps in a different order. The teachings of the invention provided herein can be applied to other systems, not only the systems described herein. The various embodiments described herein can be combined to provide further embodiments. These and other changes can be made to the invention in light of the detailed description.

Any and all the above references and U.S. patents and applications are incorporated herein by reference. Aspects of the invention can be modified, if necessary, to employ the systems, functions and concepts of the various patents and applications described above to provide yet further embodiments of the invention.

These and other changes can be made to the invention in light of the above detailed description. In general, the terms used in the following claims, should not be construed to limit the invention to the specific embodiments disclosed in the specification, unless the above detailed description explicitly defines such terms.

Referring to FIG. 1, a side perspective view of a disclosed mixer system is shown with a mixing shaft 300 superior to the blades. The mixing shaft 300 is sometimes aligned to the center reference point shown or axis in FIG. 9 as "A". Referring back to FIG. 1, a mixing blade 100 in general may be comprised of a main flat base section 110, an outer flap section 115, a middle flap section 120, an inner flap section 125 and a connection flap 130.

Figure 2:
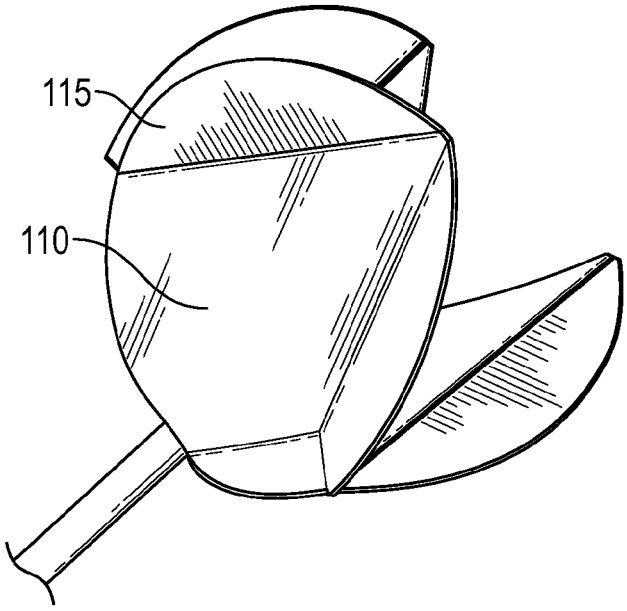
FIG. 2 is a perspective view of a disclosed embodiment

FIG. 2 depicts a disclosed system that may comprise a plurality of blades.

Figure 3:
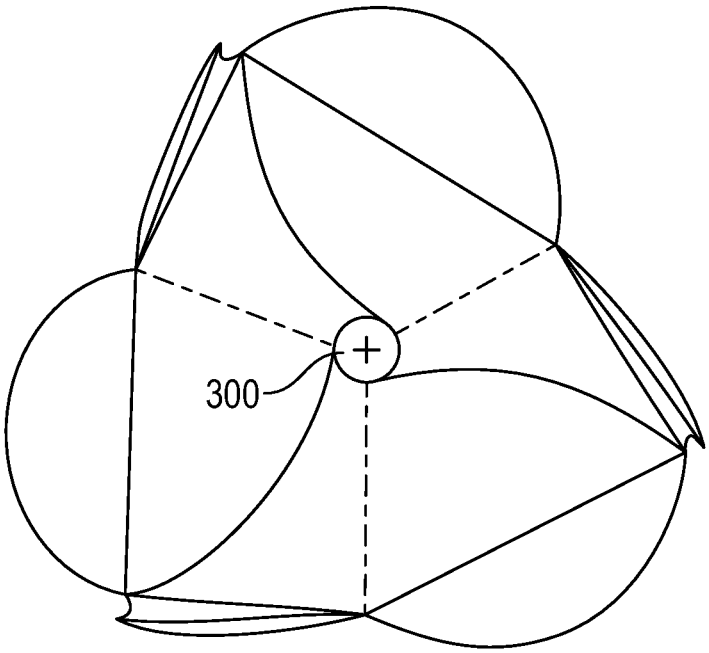
FIG. 3 is a top view of a disclosed embodiment

FIG. 3 presents a top plan view of a three blade embodiment with each blade attached to a shaft 300.

Figure 4:
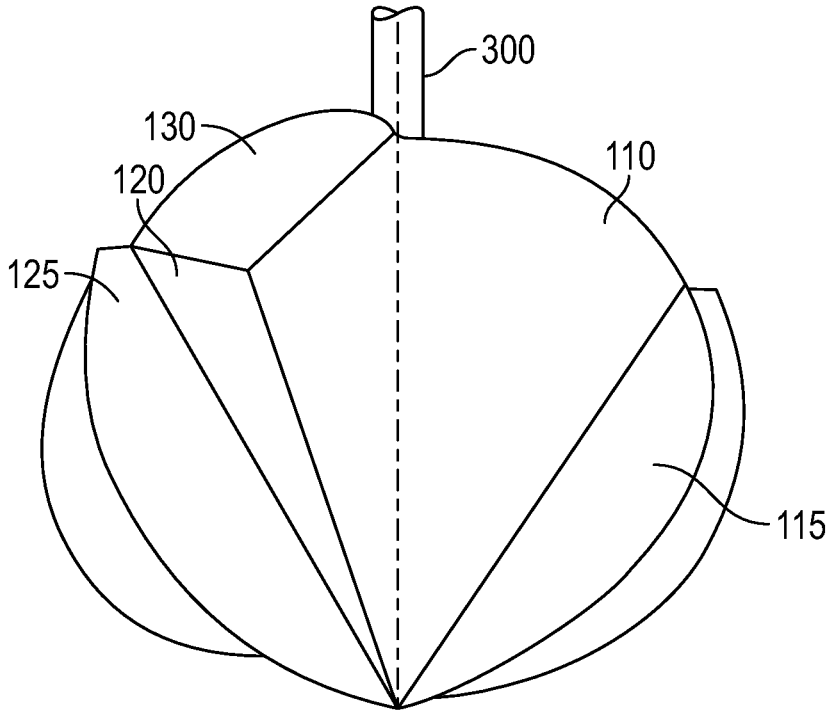
FIG. 4 is an elevation view of a disclosed embodiment

FIG. 4 depicts an elevation view of a disclosed system. FIG. 4 further depicts a blade comprising a main flat base section 110, an outer flap section 115, a middle flap section 120, an inner flap section 125 and a connection flap 130.

Figure 5:
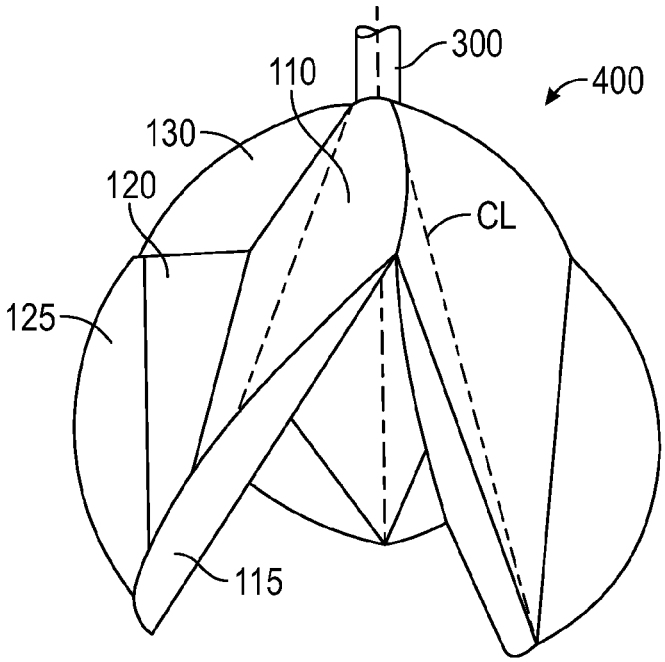
FIG. 5 is a rotated view of FIG. 4

FIG. 5 depicts a rotated view of FIG. 4 and depicts a back side of an outer flap 115 and other blade components.

Figure 6:
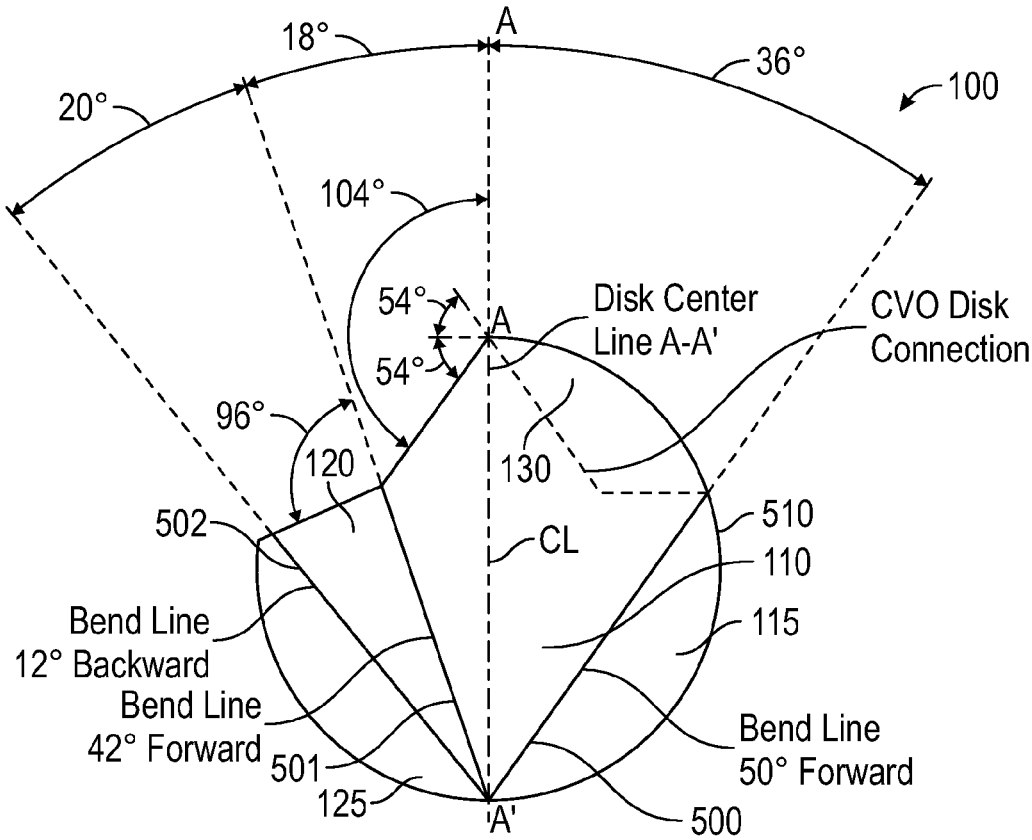
FIG. 6 is a plan view of geometry of a disclosed blade

FIG. 6 is a plan view of a disclosed blade 100 and discloses construction of a blade by use of various angles, reference lines and reference points. While certain angles are disclosed as the best mode, other angles are contemplated.

FIG. 6 discloses projection lines, angels of construction for fold lines and angles of fold. The terms "reward" and "forward" are not limiting, but are used in reference to one disclosed embodiment shown in FIG. 6 wherein the view of FIG. 6 has been arbitrarily considered to be a front view with A' on the bottom and A on the top. Other configurations are possible and other orientations are contemplated.

A blade center line of A'-A is shown in dashed lines and runs along the center and vertical diameter of a base circle 510. A base circle 510 is sometimes used as reference points for various components. A small portion (520 of FIG. 7) of the base circle is removed to complete the blade. The remaining perimeter sections of the base circle are sometimes called arc 1, arc 2 and arc 3 and are clearly shown in FIG. 17 and FIG. 18.

Figure 7:
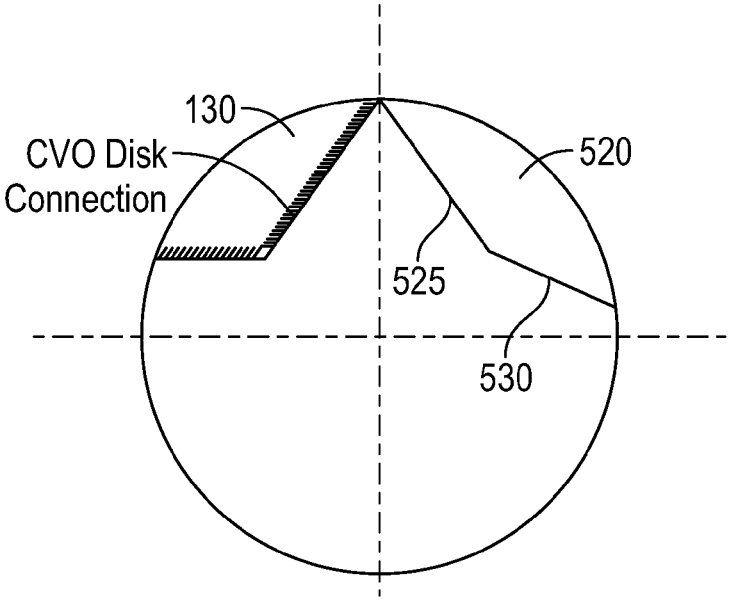
FIG. 7 is a plan view featuring a disclosed connection flap and removed section

FIG. 7 is a plan view featuring a disclosed connection flap 130, a removed section 520 and a first linear boundary 525 and a second linear boundary 530 defining outer edges of a finished blade. In the best mode known to date, the flap section is at a 54 degree angle. In general the flap section is between 45 to 65 degrees.

The view of FIG. 7 is positioned to show the relative back side of the marked disk connection area 130. The disk connection area is bent so as to facilitate the positioning of blades as contemplated in FIG. 9. The blade section formed by joining two disk connection areas can be instrumental in creating a moving vertex when spinning a disclosed blade system or assembly in fluid. While the disk connection area is perfectly symmetrical with respect to the blade centerline configuration, the assembled disc connection area presents an asymmetrical quality that is highly advantageous for mixing material.

Figure 8:
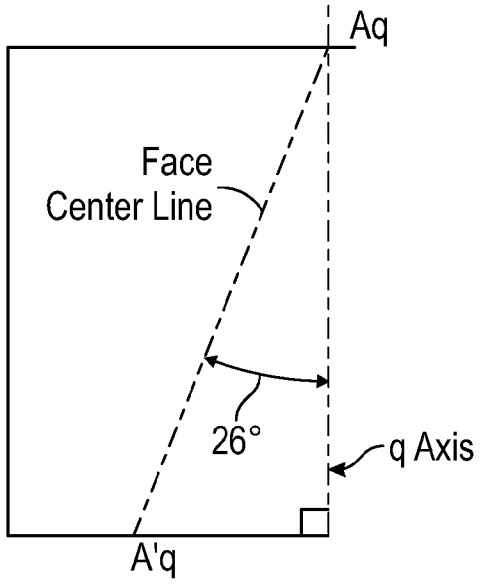
FIG. 8 is a plan view of disclosed geometry of blade attachment

FIG. 8 discloses one construction of assembling or setting a center blade line A'-A at an angle from a vertical axis line. While an angle of 26 degrees is shown, other angles are contemplated. The vertical axis line shown at a right angle in FIG. 8 is sometimes called the absolute center line. A mixing shaft 300 may sometimes be attached in alignment with the absolute center line. The absolute center line may also be called the axis line. A center line is marked at Aq on top and q Axis on the bottom. The top of the face center line is marked Aq while the bottom of the face center line is marked A'q or A prime q.

Figure 9:
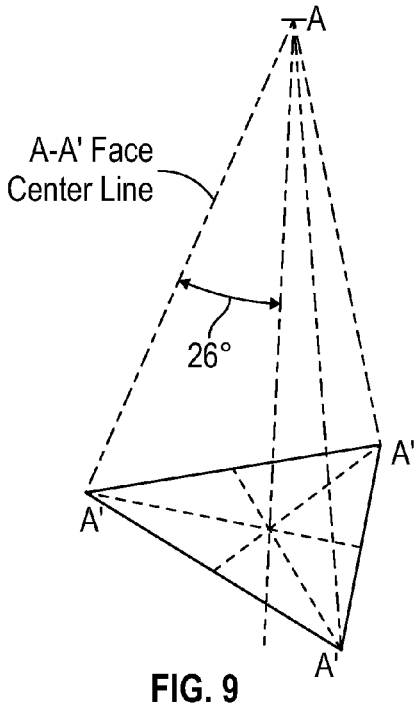
FIG. 9 is perspective view of geometry disclosing blade face orientations

FIG. 9 is a continuation of FIG. 8, in that FIG. 9 shows three centerlines for attachment of three of A'-A center lines. The displayed center line guides at a projected bottom plane take the shape of an equilateral triangle. Points A' will be angled away from the absolute center line by approximately 26 degrees.

Figure 10:
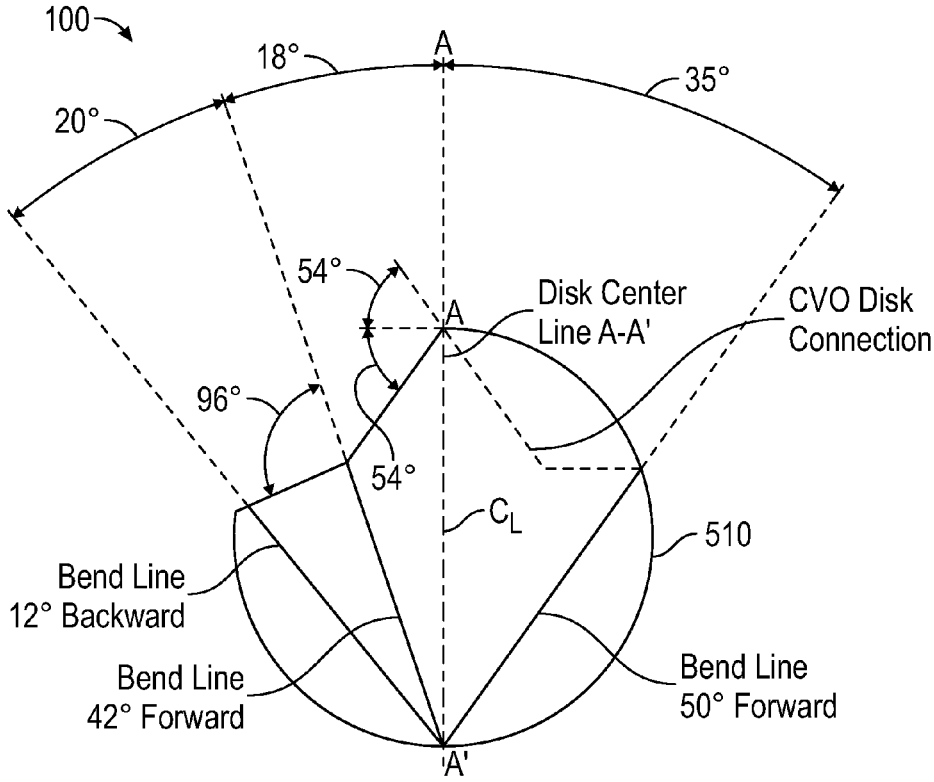
FIG. 10 is a detailed plan view of a disclosed blade

FIG. 10 is presented to more clearly reveal the disclosed angles and geometry of a disclosed blade 100. FIG. 10 more clearly shows the term CL found long line A'-A. In FIG. 10 the term CL or centerline refers to the centerline of the drawn blade. In final assembly, only point A will be adjacent to the absolute center line shown in FIG. 9.

Figure 11:
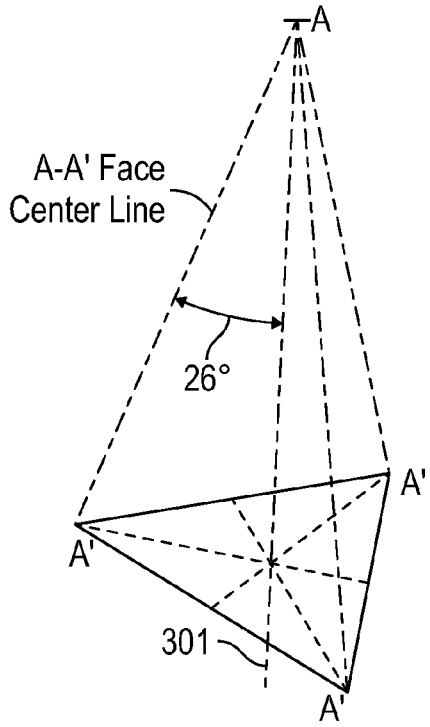
FIG. 11 is a perspective view blade orientations referenced with a center system line

FIG. 11 is a perspective view blade orientations referenced with a center system line 301. An absolute center line is found at point A and travels downwardly to the center of the drawn equilateral triangle. Three points marked A' are shown to be at an angle from the absolute center line. During construction, a temporary equilateral triangle may be used to facilitate the desired placement and retention of three blades. A construction triangle may be placed at or near the plane of the drawn equilateral triangle. Point A' and edges A are aptly named, as blade points A' and A are correspondingly attached.

Figure 12:
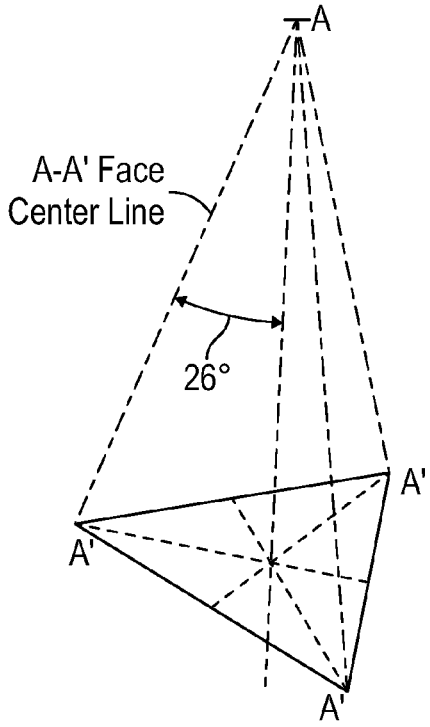
FIG. 12 is a perspective view of blade orientations

FIG. 12 is a perspective view of blade orientations. The axis is sometimes called the absolute center line.

Figure 13:
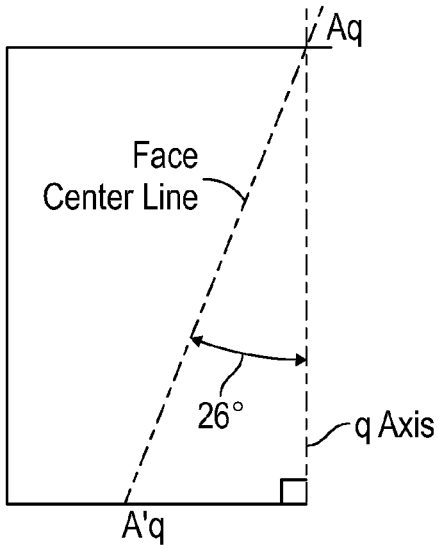
FIG. 13 is a sectional view of disclosed blade orientations

FIG. 13 is sectional view of disclosed blade orientations. A face center line is shown at an angle with respect to an axis line. The face center line could be described as an edge A-A' dihedral angle 26 degrees center line, from axis.

Figure 14:
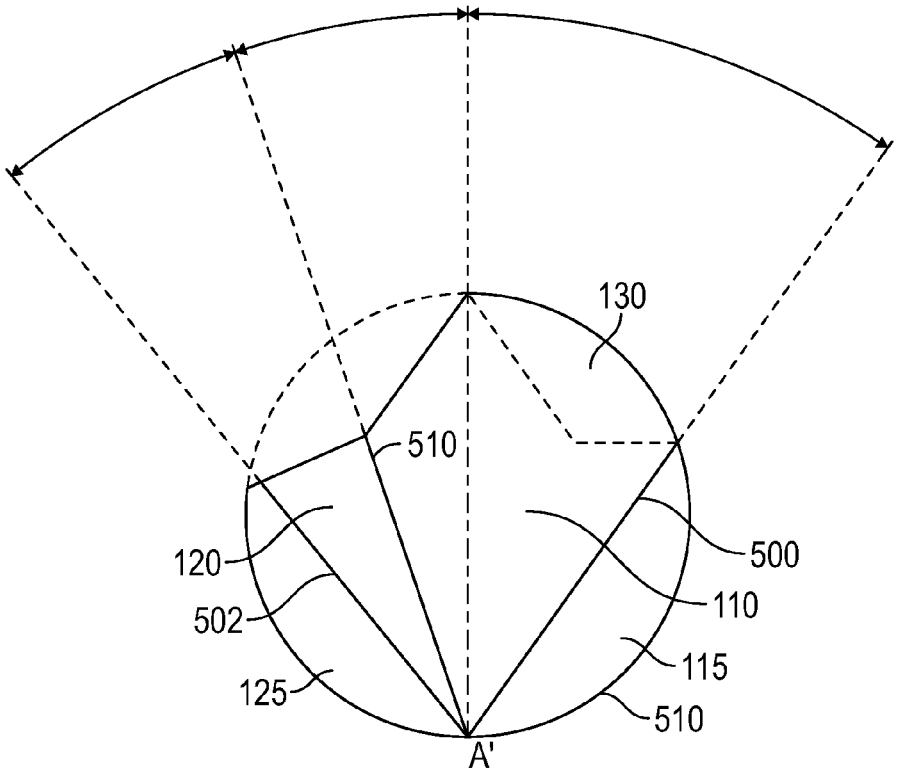
FIG. 14 is a simplified presentation of the projection lines, flap sections and geometry of a disclosed blade

FIG. 14 is a simplified version of one embodiment of a disclosed blade. Point A is shown at the bottom of the base circle 510 and point A' is shown on the top of the base circle. FIG. 14 depicts a first fold line 500, a second fold line 501 and a third fold line 502.

Figure 15:
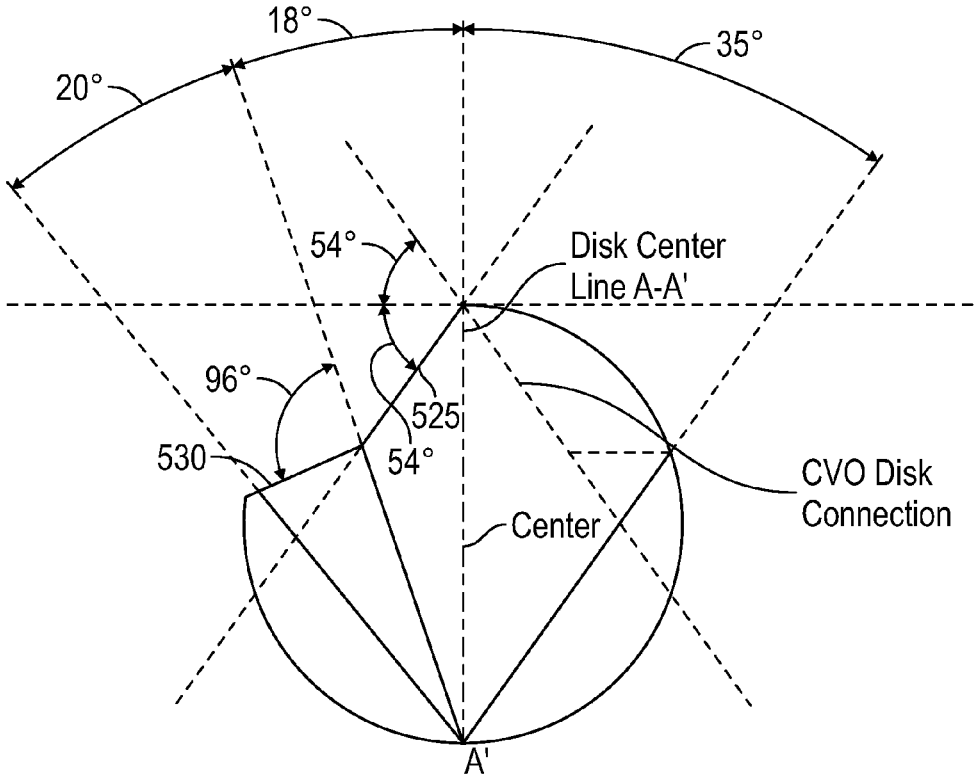
FIG. 15 is a plan view of a detailed disclosure of projection lines, flap sections and geometry of a disclosed blade

FIG. 15 depicts a plan view of a disclosed blade and presents disclosures of angles of fold lines and reference lines.

Figure 16:
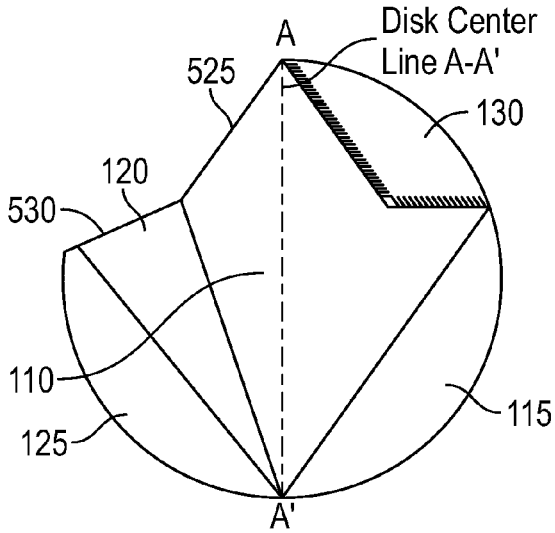
FIG. 16 is a simplified presentation of a disclosed mixing disk or mixing blade

FIG. 16 presents a disk or blade embodiment with the excess material removed just to the left of point A. The removed section is defined by lines 525 and 530.

Figure 17:
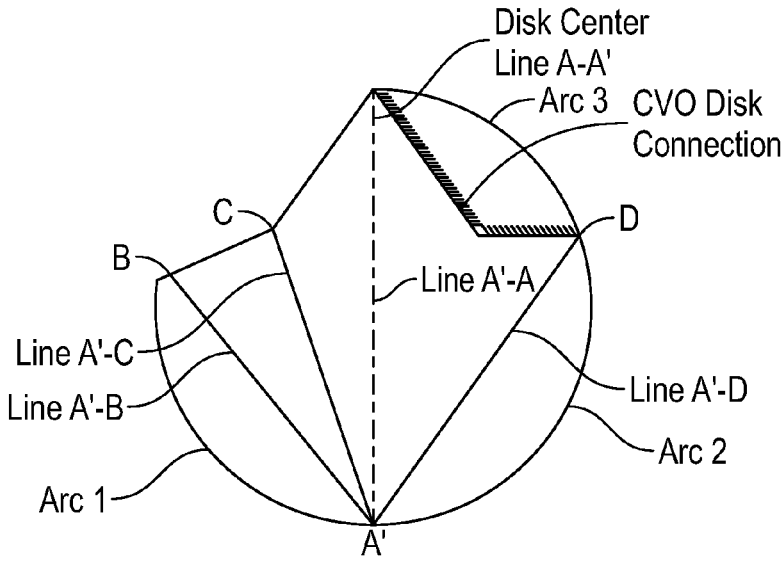
FIG. 17 is a plan view disclosing line names, arc names and point names of a disclosed blade

FIG. 17 is a plan view of a disclosed blade. FIG. 17 depicts is a blade or disk structure with various edges and points named in traditional methods. For example, points A' and C define line A'-C.

Figure 18:
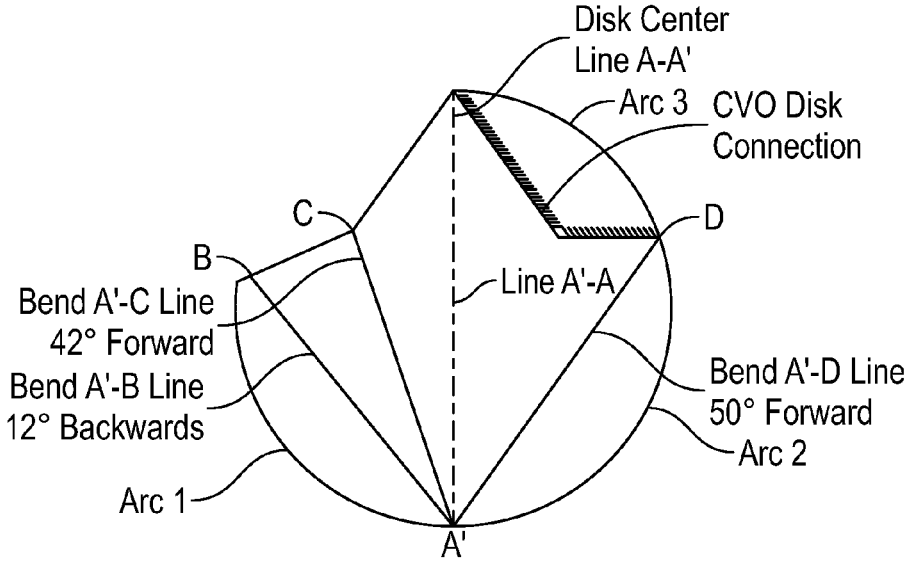
FIG. 18 is a plan view of a disclosed blade with depictions of various fold angles and other components

FIG. 18 is a plan view of a disclosed blade with depictions of various fold angles and other components and discloses various edges, points and angle of folding.

Disclosed embodiments include, but are not limited to the following items:

Item 1. A mixing and vortex organizing system, the system comprising:

a plurality of mixing blades wherein each mixing blade comprises:

a planer circular surface comprising three fold lines and a neutral center line with a first fold line bent in a forward direction between 45 and 55 degrees from the neutral center line, a second fold line bent in a forward direction between 35 and 45 degrees from the neutral center line and a third fold line is bent in a backward direction 6 to 18 degrees from the position of the second fold line, and a disk connection section defined between first fold line and the neutral center line, the plurality of mixing blades fastened to each other at each respective disk connection section; and a mixing shaft connected to the attached plurality of mixing blades.

The system of item 1 wherein the planer circular surface comprises a lower center reference point and the neutral center line starts at the lower center reference point and ends at an upper center reference point and wherein the first fold line is between 30 and 40 degrees from the lower center reference point and wherein the second fold line is between 15 and 25 degrees from the lower center reference point and wherein the third fold line is between 15 to 25 degrees from the second fold line.

The system of item 2 wherein the planer circular surface is reduced at two edge lines, the first edge line defined at an angle of between 100 to 110 degrees from the upper center reference point to the second fold line and the second edge line is defined at an angle of between 90 to 100 degrees from the third fold line.

The system of item 3 wherein the connection section is at an angle between 50 to 60 degrees.

The system of item 4 wherein the plurality of mixing blades are each angled between 16 and 26 degrees from a central center line located equidistant from the mixing blades.

What is claimed is:

1. A mixing and vortex organizing system, the system comprising:

a) a plurality of mixing blades wherein each mixing blade comprises:

i. a planer circular surface comprising three fold lines and a neutral center line with a first fold line bent in a forward direction between 45 and 55 degrees from the neutral center line, a second fold line bent in a forward direction between 35 and 45 degrees from the neutral center line and a third fold line is bent in a backward direction 6 to 18 degrees from the position of the second fold line, and a disk connection section defined between first fold line and the neutral center line, b) the plurality of mixing blades fastened to each other at each respective disk connection section; and c) a mixing shaft connected to the attached plurality of mixing blades.

2. The system of claim 1 wherein the planer circular surface comprises a lower center reference point and the neutral center line starts at the lower center reference point and ends at an upper center reference point and wherein the first fold line is between 30 and 40 degrees from the lower center reference point and wherein the second fold line is between 15 and 25 degrees from the lower center reference point and wherein the third fold line is between 15 to 25 degrees from the second fold line.

3. The system of claim 2 wherein the planer circular surface is reduced at two edge lines, the first edge line defined at an angle of between 100 to 110 degrees from the upper center reference point to the second fold line and the second edge line is defined at an angle of between 90 to 100 degrees from the third fold line.

4. The system of claim 3 wherein the connection section is at an angle between 50 to 60 degrees.

5. The system of claim 4 wherein the plurality of mixing blades are each angled between 16 and 26 degrees from a central center line located equidistant from the mixing blades.

* * * * *